US005214400A

United States Patent [19]

Roos

[11] Patent Number: 5,214,400

[45] Date of Patent: May 25, 1993

[54] GALVANIC SWITCH

[75] Inventor: Sture G. Roos, Bergshamra, Sweden

[73] Assignee: Telefonaktiebolaget L M Ericsson, Stockholm, Sweden

[21] Appl. No.: 899,321

[22] Filed: Jun. 16, 1992

[30] Foreign Application Priority Data

Jun. 17, 1991 [SE] Sweden ..... 9101868

[51] Int. Cl.[5] ..... H01H 64/14

[52] U.S. Cl. ..... 335/112; 200/177

[58] Field of Search ..... 200/175, 176, 177; 335/106, 107, 109, 110, 111, 112

[56] References Cited

U.S. PATENT DOCUMENTS

| | | | |
|---|---|---|---|
| 2,647,166 | 7/1953 | Lens | 200/177 |
| 3,387,108 | 6/1968 | Reimer . | |
| 3,614,330 | 2/1968 | Chaveneaup et al. | 335/112 |
| 3,868,610 | 2/1975 | Salam | 335/112 |
| 4,138,197 | 2/1979 | Minton | 200/178 |
| 4,222,675 | 9/1980 | Brown et al. | 335/112 |
| 4,954,674 | 9/1990 | Roos . | |

*Primary Examiner*—Lincoln Donovan
*Attorney, Agent, or Firm*—Burns, Doane, Swecker & Mathis

[57] ABSTRACT

A galvanic switch for electrically making or breaking one cross-point among a plurality of cross-points in a three-dimensional switching matrix. The switch includes electrical contact lines, first links which extend perpendicular to the contact lines, and second links which extend perpendicular to both the contact lines and the first links. At each cross-point, there is located a contact element in the form of a spherical element for making and breaking the electric contact respectively. The contact elements either make or break the cross-point depending on whether the coupling element is conductive or non-conductive, and are maneuvered by maneuvering elements. In a first selection, first maneuvering elements are maneuvered so as to move all coupling elements simultaneously in a chosen first plane of cross-points, where-after second maneuvering elements are maneuvered so as to move simultaneously all of the coupling elements moved by the first maneuvering element in the intersection between the first selected plane and a selected second plane of cross-points. Maneuvering of third maneuvering elements for moving the coupling element moved by the first and the second maneuvering elements in the intersection between the selected second plane and a selected third plane is utilized as a coupling function for bringing into the cross-point a coupling element of opposite kind to the coupling element already present in the cross-points.

6 Claims, 7 Drawing Sheets

GALVANIC SWITCH

FIELD OF THE INVENTION

The present invention relates to a galvanic switch for electrically making or breaking one cross-point among a plurality of cross-points in a three-dimensional switch or connector matrix, wherein each of said cross-points may comprise of one or more conductors, including electrical contact lines which extend in a first direction; first links which extend perpendicularly to said contact lines; second links which extend perpendicularly to both the contact lines and the first links, wherein each contact line, first link and second link, is comprised of a corresponding number of conductors, electrical contact elements at each cross-point for making or breaking electrical contact between the conductors of the contact lines and the conductors of the first or the second links respectively, and maneuvering elements for maneuvering the contact elements at said cross-point, including first maneuvering elements which are parallel with the contact lines and can be moved parallel thereto, second maneuvering elements which are parallel with the first links and can be moved parallel thereto, and third maneuvering elements which are parallel to the second links and can be moved parallel thereto.

BACKGROUND OF THE INVENTION

Many versions of galvanic switching devices or connectors of different kinds have been known to the art for a number of years. Such switches have been revitalized for use with controllable cross-connectors. The ball switch belongs to this switch category. The requirement for cross-connectors is found in many fields, with the size of such connectors varying from some tens of lines to some tens of thousands of lines and for frequencies between just a few kHz to some hundreds of MHz. The difficulty is found in producing simple units of this kind at low cost and in small volumetric sizes and which are not power consuming after being operated. In many applications, the switches are in operation only a few times each year.

The known switches are normally of the x-y selector type, i.e., selection is effected in two planes, for example the code selector, the coordinate selector, the ball selector or ball switch. In order to enable larger switching or selector networks to be constructed, it is necessary to connect these switches in several stages with the aid of link coupled systems, for instance a system of the kind illustrated in FIG. 1. As will be seen from the Figure, link coupling results in serious problems, such as requiring large quantities of cable, rotation of the links between the various stages, and the provision of different maneuvering devices for manipulation of the various selector modules. Furthermore, in the case of cross-connectors, it is undesirable to differentiate between In and Out as in the FIG. 1 illustration. This can be achieved by coupling $i_1$ with $u_1$, and coupling $i_2$ with $u_2$, and so on. This results in a so-called folded selector network which may have the configuration shown in FIG. 2. The aforementioned problem prevails, however.

The aforesaid problems can be solved by means of a switch of cubic construction. The cube incorporates several selector stages in a manner which excludes the aforementioned links, i.e., link cabling is not necessary. Rotation of the links has been achieved by utilizing all of the x-y and z-directions, i.e., with the aid of a three-dimensional coupling field with electric contacts in three dimensions. Maneuvering is accomplished by utilizing a selection in three dimensions common for all selector stages in the cube.

The x, y and z-planes have been utilized to form the link-coupled structure and a plurality of selectors in one and the same unit. FIG. 2 illustrates the link coupling structure. This structure can be drawn in a manner of the structure shown in FIG. 3, and a configuration according to FIG. 4 can be obtained by moving the center stages in between the contacts in the first selector stage. Each cross-point may consist of one or more conductors having a contact function, for instance similar to the ball switch or some other maneuverable contact function. It is not necessary to have external access to the links y and z, and consequently all connections to the coupling field are effected from one side. The contact function shall be mechanically bistable.

Switches of the aforedescribed kind are known to the art. One drawback with switches of this kind, however, is that maneuvering of a selected cross-point, i.e., the choice of x, y and z-coordinates, is effected by means of individual maneuvering means for the respective different coordinates. The switch therefore includes a large number of maneuvering means and the switch as a whole is unnecessarily expensive and space consuming. It is not possible to reset the switch quickly and simply, but requires individual maneuvering of all cross-points, therewith taking a long time to reset.

SUMMARY OF THE INVENTION

The object of the present invention is to eliminate the drawbacks of known switches of the aforesaid kind, and to provide a galvanic switch of simple construction which will operate quickly and reliably and which is inexpensive and does not require a large amount of space. This object is achieved with a switch having the characteristic features set forth in the accompanying Claims.

Maneuvering of the cross-points in the cube is effected individually. A cross-point is indicated and maneuvered in the x, y and z-plane, by selecting a contact element, for instance a ball, by effecting three movements in the x, y and z-planes. FIG. 5 illustrates the principle on which the choice is made. A first choice function results in movement of all contact elements in a single plane, for instance in the x-direction or x-plane. During this movement, the contact elements take a position in which movement of one plane in the y-direction will only move those contact elements which form intersections between the x-y plane and the y-z plane. During movement of a plane in the y direction, the contact elements which form intersections between the x-y plane and the y-z plane take a position in which they can be influenced by a plane in the z-direction. Thus, there is indicated a point in the space in the intersection plane between the x-y plane, the x-z plane and the y-z plane. Movement in the z-plane can be used advantageously for switching a contact function on and off.

The planes are preferably moved with the aid of electromagnets or hydraulic devices positioned on the sides of the cube selector. The various planes are constructed from maneuvering elements, for instance in the form of bars or cams, with the contact elements positioned so as to be moveable in the x, y and z-direction, as shown in FIG. 5. The planes are obtained by joining together the outer edges of the bars, so that the bars can be maneuvered together in a single plane, as described above.

The cube selector is constructed by combining the aforedescribed contact function with the maneuvering function described above, so as to form a unit, i.e., a cube switch or selector.

The invention will now be described in more detail with reference to a preferred exemplifying embodiment thereof and also with reference to the accompanying drawings.

DETAILED DESCRIPTION OF THE PREFERRED EMBODIMENTS

Figure 1:
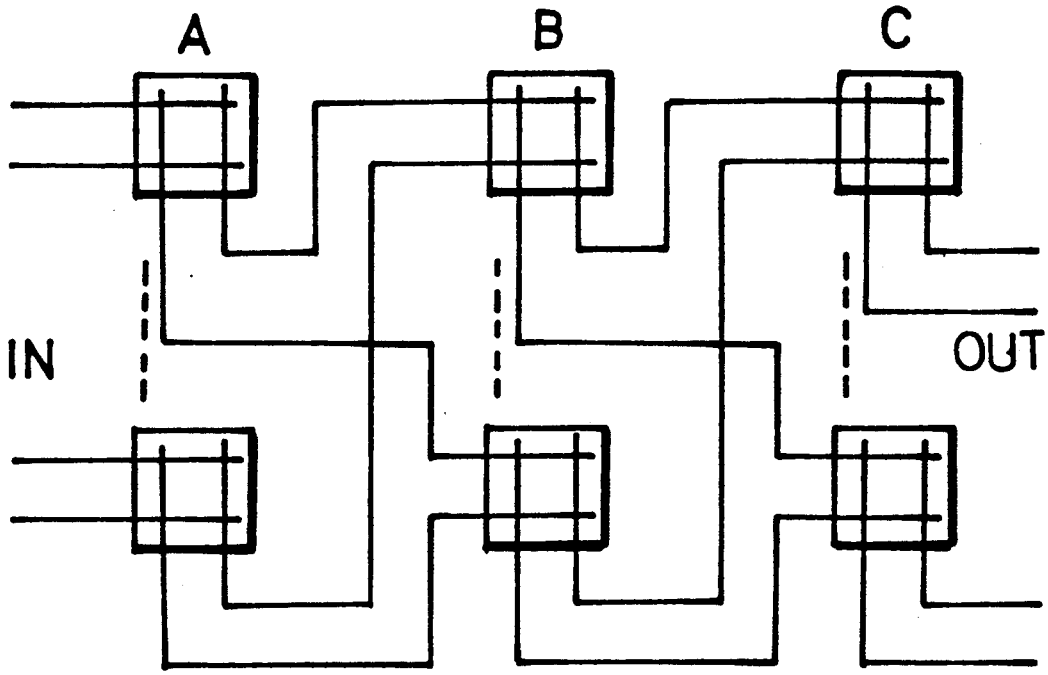
FIGS. 1–4 illustrate in principle the manner in which a switch network can be formed into a three-dimensional cross connector module.
Figure 2:
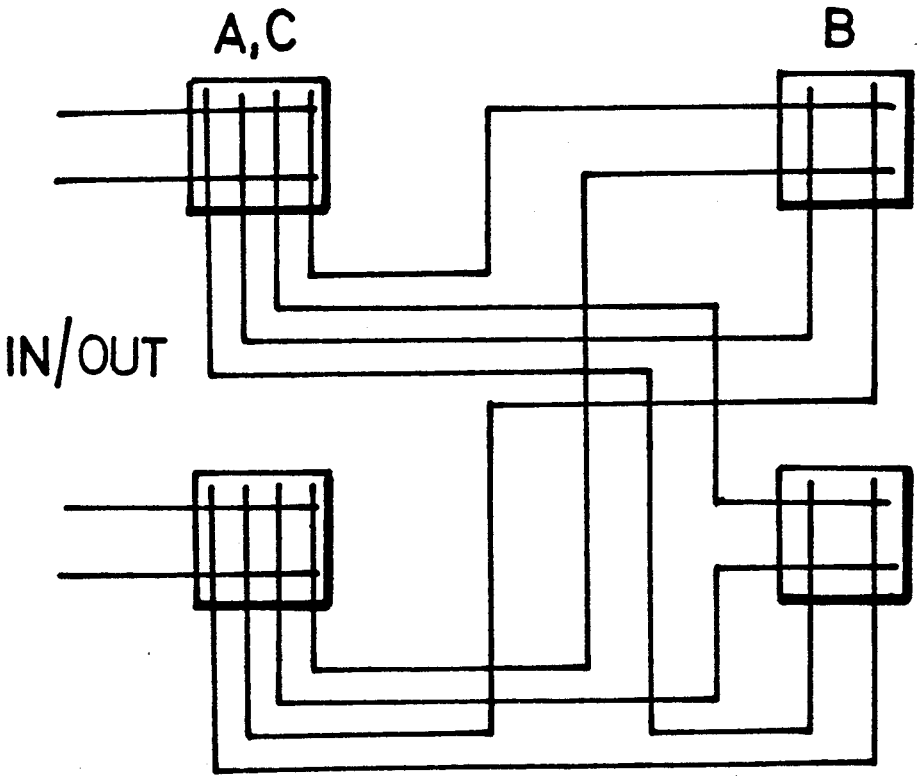
Figure 3:
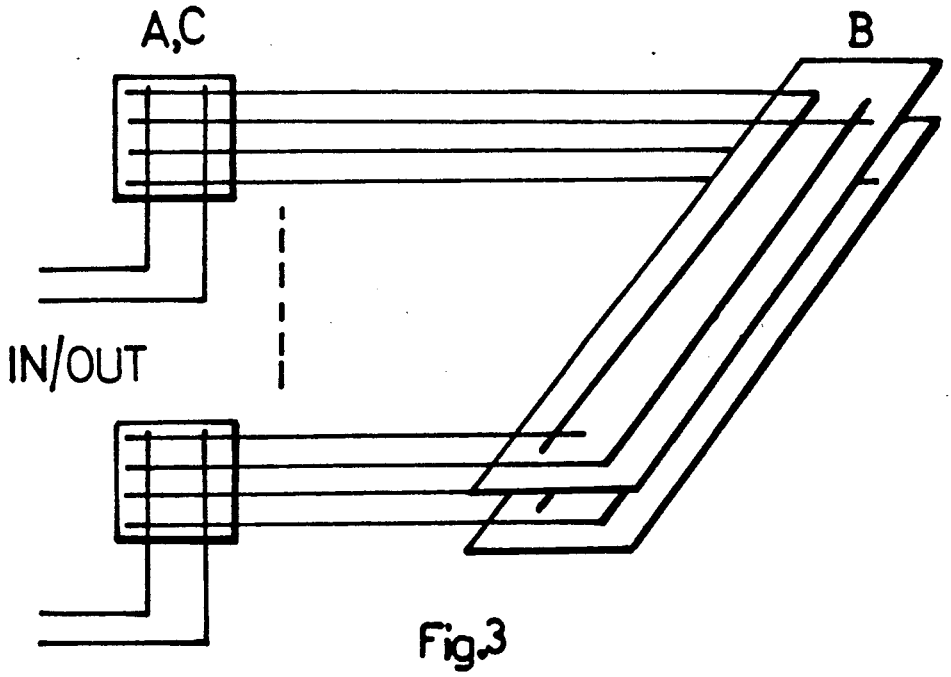
Figure 4:
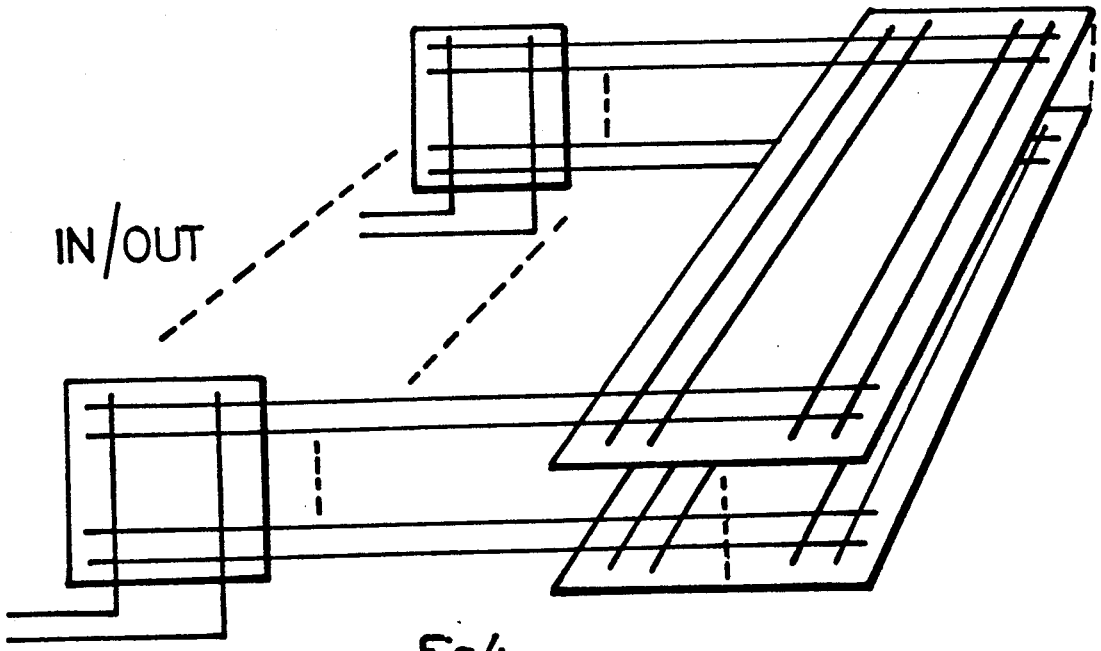
Figure 5:
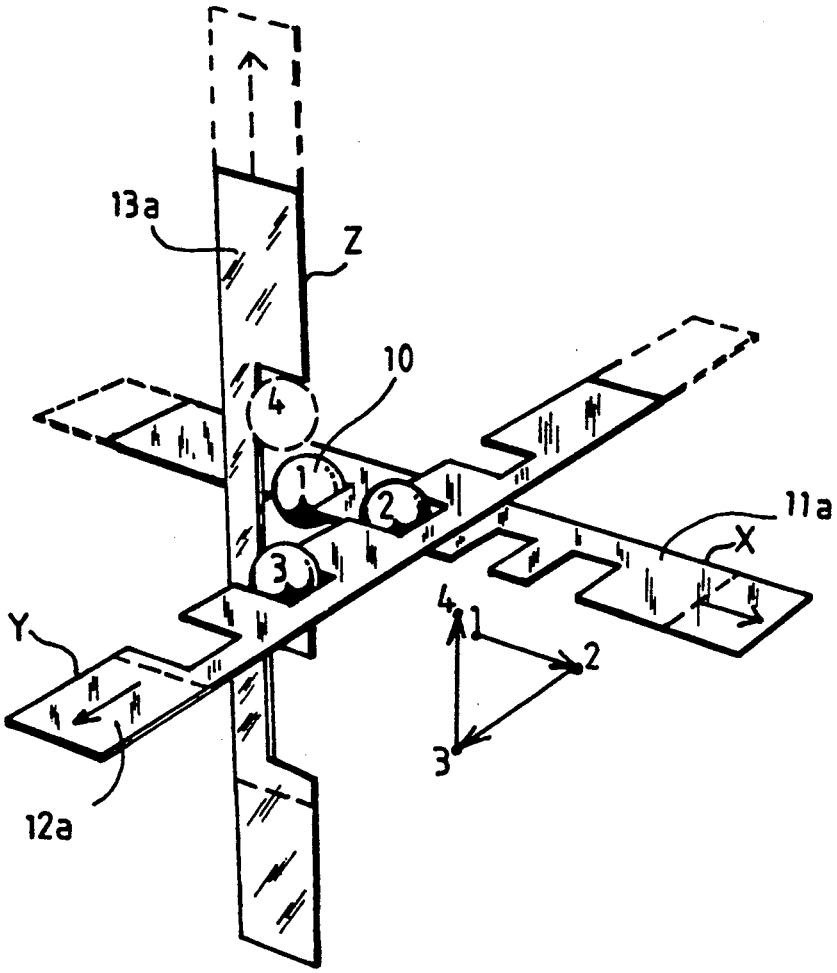
FIG. 5 illustrates in principle the manoeuvering function in a cross-point of a galvanic cross connector constructed in accordance with the present invention.
Figure 6:
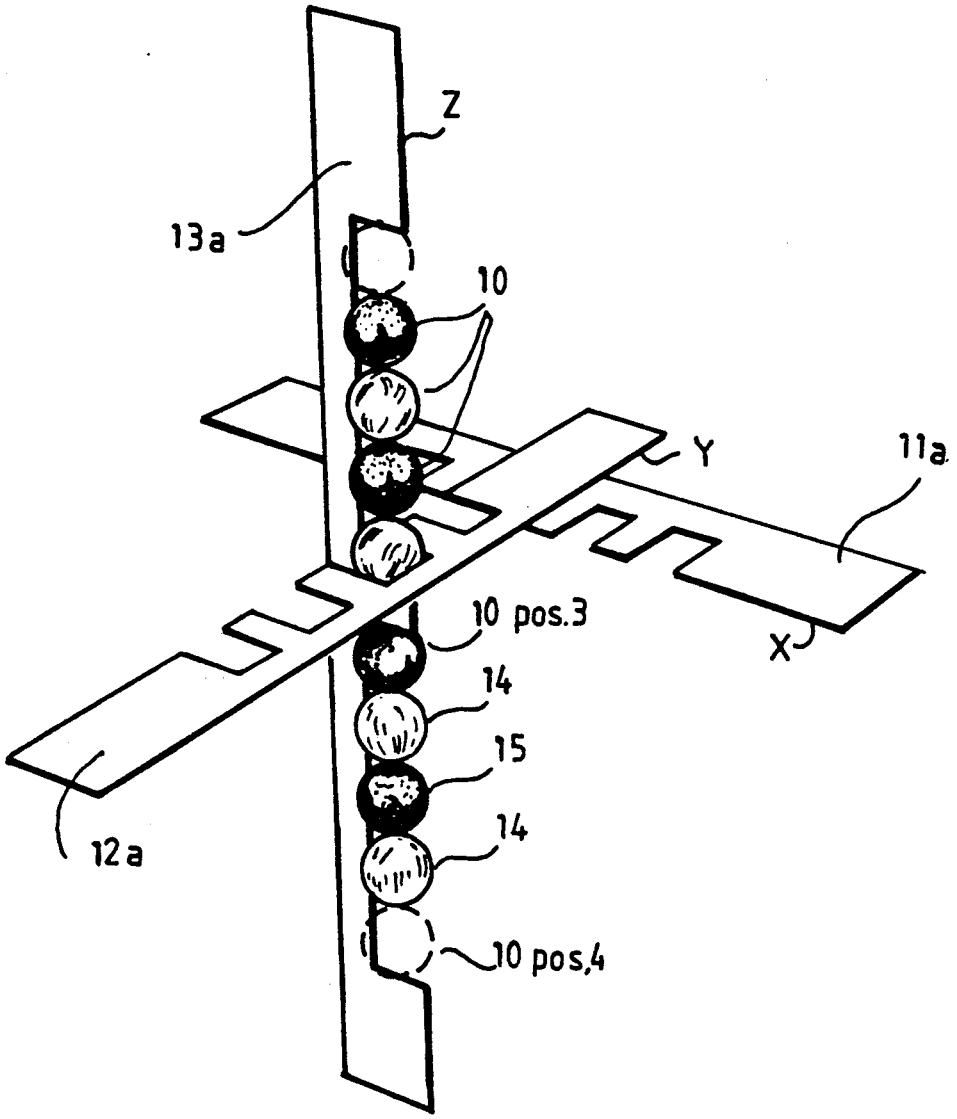
FIG. 6 illustrates in principle the on/off switching function at a cross-point.

FIG. 5 illustrates in principle the manner of maneuvering a switch cross-point. Three different types of maneuvering elements, each including several bars, are used to move an electric contact element located in the vicinity of the selected cross-point. The contact elements have the form of spherical connector elements, or balls, of which half are electrically conductive and the remainder electrically insulating, so as to make or break an electric connection at the cross-point. For the sake of simplicity, only one bar has been shown in each maneuvering element, and no contact lines or links have been shown in FIG. 5 for the same reason. A bar 11*a*, referred to here as the x-bar, included in a first maneuvering element 11, can be displaced in the x-direction according to the FIG. 5, from a neutral position, shown in broken lines, to an activated position. A contact element 10 which was initially located outside the cross-point although in the vicinity thereof, in a recess in the bar in position 1, is therewith moved by the bar 11*a* to position 2 and inserted into a recess in a bar 12*a*, the y-bar, included in a second maneuvering element 12, said y-bar being moveable perpendicularly to the bar 11*a* in the y-direction. The bar 12*a* is then moved from its neutral position, shown in broken lines in FIG. 5, to an activated position, said contact element 10 being moved to position 3 and inserted into a recess in a bar 13*a*, the z-bar, included in a third maneuvering element 13. As indicated in broken lines, the bar 13*a* can be moved perpendicular to both the bar 11*a* and the bar 12*a* in the z-direction, and is used as an off/on function to move the contact element 10 to position 4, as explained in more detail herebelow. Located at each cross-point is a ball train consisting of three contact elements 10. In the starting position of the selector switch, i.e., the state in which no cross-point is activated, the ball train includes two insulating balls 14 and an intermediate, conductive ball 15. The insulating balls are positioned between contact lines and contact tongues in contact links, as described herebelow. FIG. 6 illustrates in the lowerpart the position of the ball train in the bar 13*a*, in the neutral position, whereas the upper part of FIG. 6 illustrates the activated, or switched-on state of the switch. As will be seen from FIG. 6, the ball receiving recess in the bar 13*a* has a width which corresponds to five ball-diameters. In the neutral position, the bar 13*a* takes a position in which the ball train is located centrally in the recess, with an empty space corresponding to the diameter of one ball at each end of the train. When maneuvering the cross-point by means of the maneuvering elements 11 and 12, the ball which initially lay outside the cross-point although in the vicinity thereof, position 1 in FIG. 5, enters the recess of the bar 13*a* either at the top or at the bottom of the ball train, position 3. It should be noted that two x-bars 11*a* and two y-bars 12*a* are provided for each cross-point, although only one pair of such bars has been shown in the Figures, for the sake of clarity. The pair of x and y-bars not shown in the drawing is disposed in the space in the recess of the z-bar present on the opposite side of the ball train. When the z-bar 13*a* is moved downwards in FIG. 6, the contact element 10 in position 3 will move the ball train downwards, therewith replacing an insulating ball 14 with a conductive ball 15 and vice versa. The bottom part of FIG. 6 illustrates the state of the switch prior to moving the z-bar, while the upper part of FIG. 6 shows the state of said switch subsequent to moving said bar. When the y-bar and x-bar are returned, the maneuvering elements 12 and 11 are deactivated in that order and the contact element is returned to its original position 1, outside of the cross-point although in the vicinity thereof, as shown in FIG. 5, but is now located in the other pair of x and y-bars.

Figure 7:
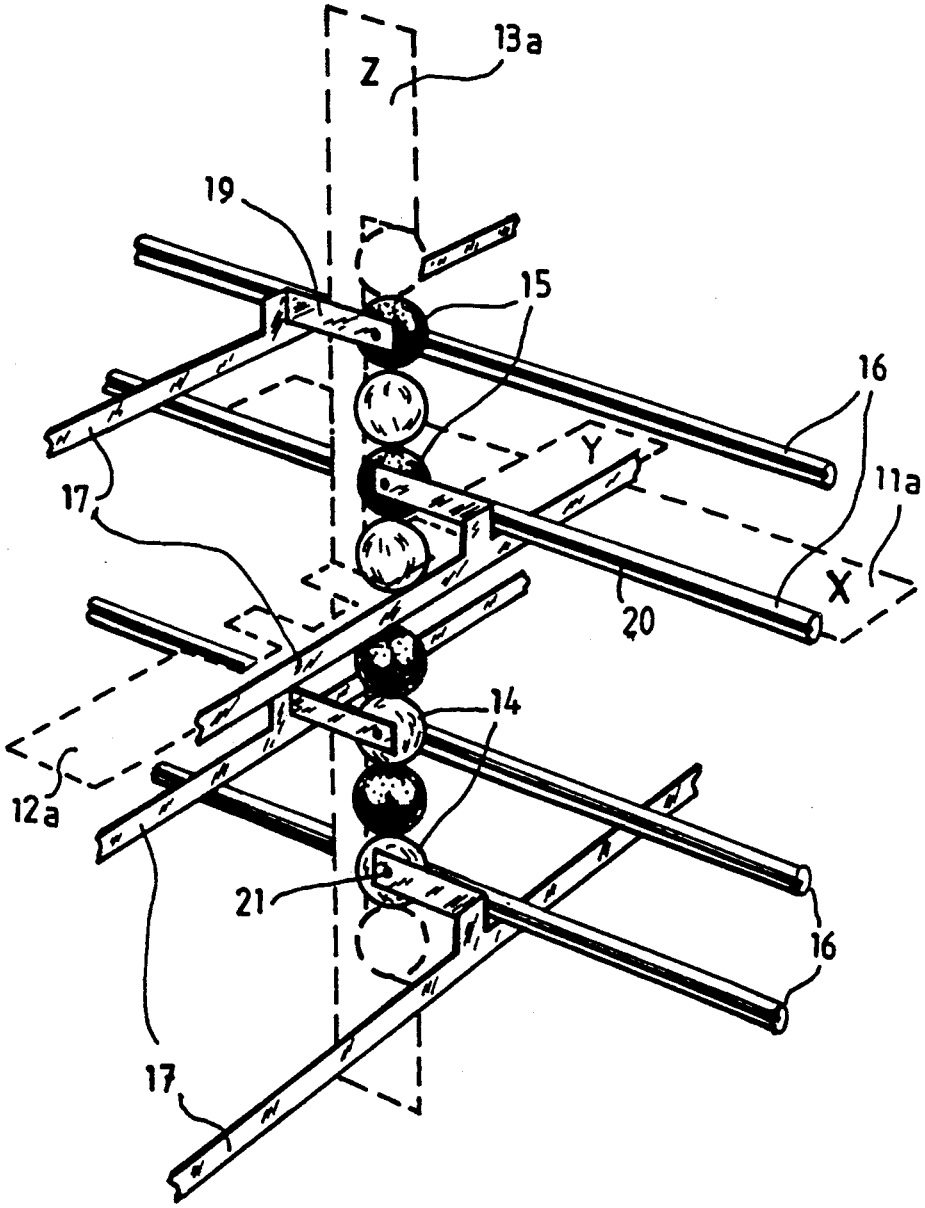
FIG. 7 illustrates the contact function between contact lines and first links with a closed and a broken contact respectively at two cross-points.
Figure 8:
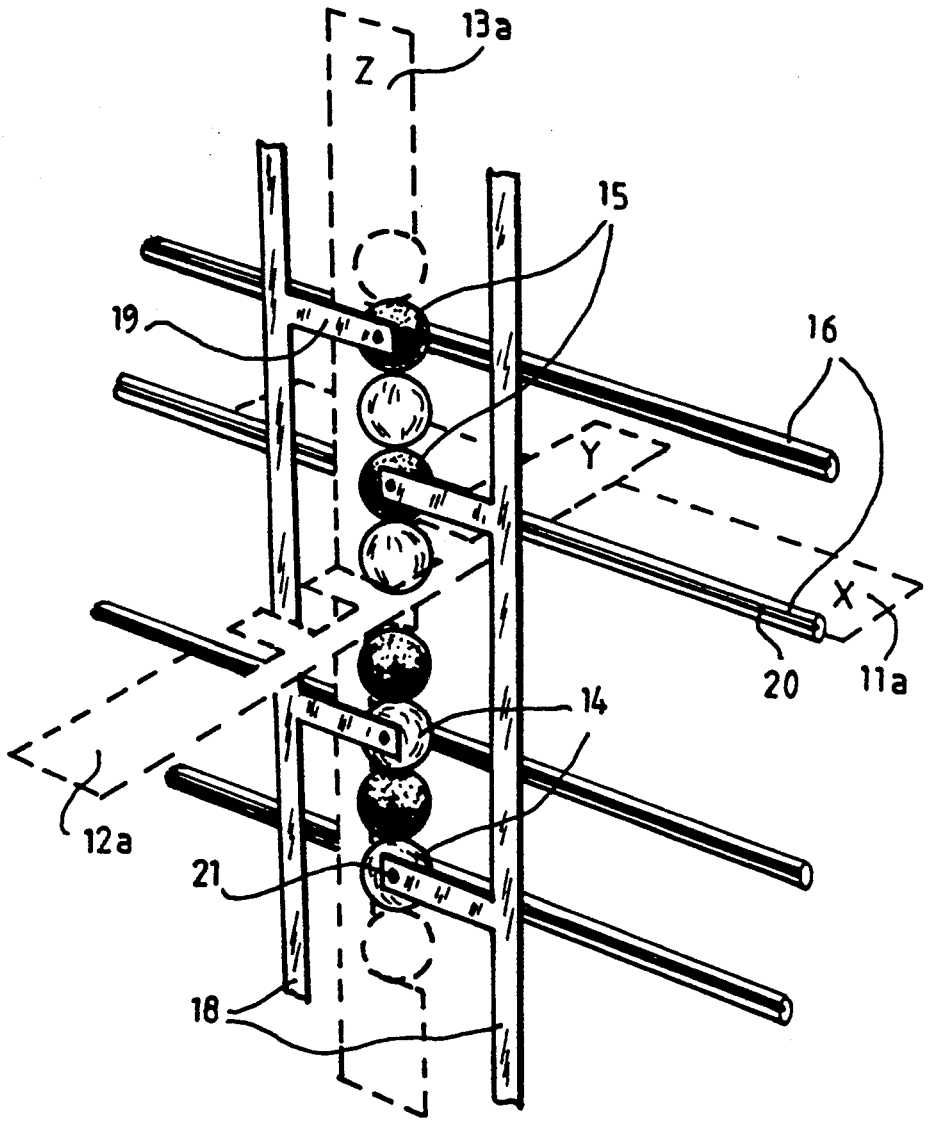
FIG. 8 illustrates the contact function between contact lines and second links with a closed and a broken contact respectively at two cross-points.

Having described the actual maneuvering function above, the electrical contact function will now be described in more detail with reference to FIGS. 7 and 8. The switch includes contact lines 16 which extend parallel to the x-bars 11*a* of the maneuvering elements 11 and to which external incoming and outgoing lines are connected. Cross-connection is also achieved with the aid of first links 17 which extend parallel with the y-bars 12*a* of the maneuvering elements 12, and second links 18 which extend parallel with the z-bars 13*a* of the maneuvering elements 13. The links 17 and 18 are used solely to achieve the actual cross connection within the switch and no external access is necessary. Also shown in FIG. 7 are two cross-points with contact lines 16 and first links 17 respectively, wherein the upper part of the Figure shows a closed or activated cross-point with electric contact achieved through the conductive balls 15 located between the respective lines 16 and links 17, whereas the bottom part of the Figure illustrates an electrically broken cross-point. The first links 17 are provided with tongues 19 at the actual contact point itself. In the illustrated embodiment, the contact lines 16 have the form of round rods provided with V-shaped grooves 20, and the tongues 19 are pitted with depressions or provided with holes 21 for the intention of providing a surface which will hold the ball train in position. FIG. 8 illustrates, in a similar manner, two cross-points with contact lines 16 and second links 18 respectively. The upper part of this Figure also illustrates an activated cross-point and the lower part of the Figure an electrically broken cross-point. Similar to the links 17, the links 18 are provided with contact tongues 19, which are also embossed, pitted or configured in some other way with the purpose of holding the ball train in position.

Figure 9:
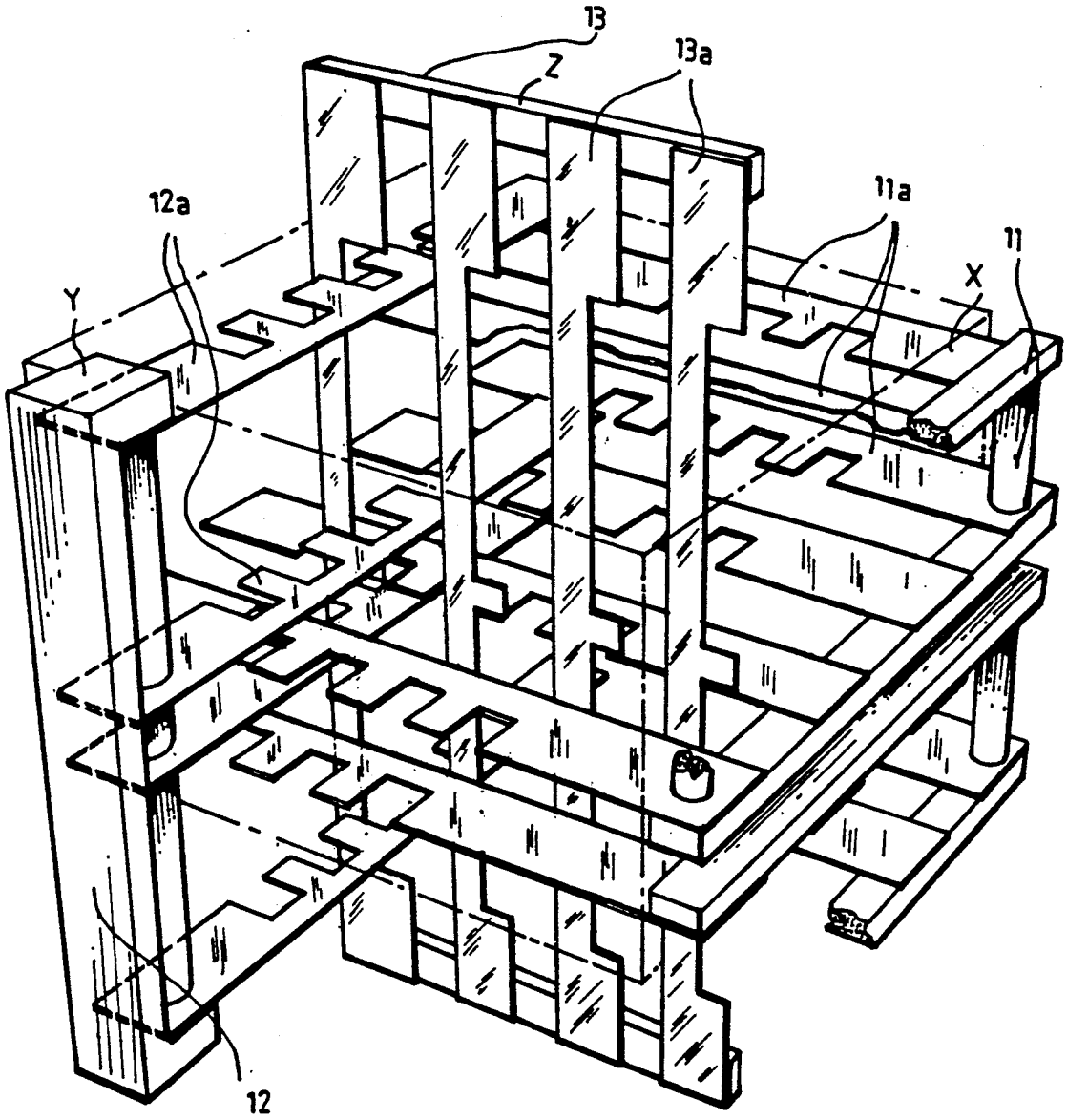
FIG. 9 illustrates the manoeuvering elements and their mutual relationship in the three-dimensional connector matrix.

Thus, the contact function and maneuvering function in the illustrated switch are achieved with the aid of balls, as in a ball switch. An electrical contact is made or broken by moving a ball train which consists of two insulating and one conductive ball, by means of another conducting ball, or by moving a ball train which consists of one insulating and two conductive balls by means of another insulating ball. Balls and contact lines are positioned in contact blocks in which maneuvering bars are also found. The switch is switched on and off, by moving the balls with the aid of a z-bar in which the distance between the pins equals the combined diameters of five balls. As illustrated in the drawings, one ball is located outside of the cross-point, although in the vicinity thereof. The bars on both sides of the contact block are joined together and are moved pairwise when moving in the x and y-directions. After maneuvering a cross-point (including two contact lines in the illustrated embodiment), the ball which lies outside the ball train will enter a recess in the y-direction bars. When the y-direction bar is moved, this ball will then be moved to a position which is not in the position of the ball train, and hence only three balls will be left in the z-direction bar. In this new operational state, the ball will enter a recess in the x-direction bars, which, in turn, moves the balls to their neutral position. At the beginning of a maneuvering operation, all balls in the cube are in their neutral positions. By connecting all bars in the x-direction, as illustrated in FIG. 9, in which the x-bars 11*a* are mutually connected in two planes to the maneuvering elements 11, which lie in a plane x-y, all balls in this plane can be moved from their neutral position to a central position. The balls located in the central position can now be moved with the y-bars 12*a*, which are connected to the maneuvering elements 12 in a plane y-z perpendicular to the x-direction plane. When these y-direction bars are moved to the manoeuvering position, all balls which are located in a row in the intersection between the two planes will follow said movement to the maneuvering position. By mutually connecting the z-direction bars 13*a* to the maneuvering elements 13 in a plane perpendicular to the y-z plane, only one of the balls now located in the maneuvering position will be moved in response to movement of the z-direction bar, therewith maneuvering only one cross-point. During this maneuvering operation, one ball will enter the position of the ball train and a corresponding ball on the other side will enter the y-direction bar which forms the pair for the cross-point. This ball is returned to the maneuvering position in accordance with the aforegoing. The surfaces of the contact tongues are embossed or likewise roughened, so as to hold the balls firmly between the contacts.

As will be evident from the earlier Figures, the x-contact lines have the form of straight conductors. The cube can be constructed from a plurality of plastic plates incorporating the y-links and the z-links. The plastic plates are then assembled to form a larger block (a cube). Because the x-conductors are straight, they can be inserted through a slot transversely to the plates. The plates are configured to enable the bars to be inserted into a cube which has already been assembled. The balls are positioned in the cube, by placing said balls in respective compartments when inserting the z-bar and advancing the z-bar incrementally so as to press said balls into the cube. At the end of this ball-charging or ball-positioning operation, all balls will be located in a maneuvering position and by moving all z-bars to/from, all contacts will lie in the off-position. As the balls are being loaded, the x and y-bars are in an activated position, therewith enabling all balls to be moved to their starting positions, by first deactivating all y-bars and then all x-bars. This operation can also be used for "resetting" purposes, i.e. to switch-off all cross-points without needing to maneuver all cross-points individually, although this may be necessary should controlling equipment lose information as to which cross-points have been set.

Both the bars and the contact lines are through-passing, which means that large units can be constructed, by stacking several cubes on top of one another, adjacent one another and behind one another. This enables very large units to be constructed from smaller basic models.

Maneuvering is effected with the aid, for instance, of electromagnets placed in maneuvering modules on four sides of the cube. The maneuvering modules interconnect and maneuver the cams. The four sides of the cube are used for x, y and on/off. The x and y bars are held deactivated by means of springs for instance, and the on/off bar or the z-bar is held in its central position when none of the on-coils or off-coils have been energized. All cabling inputs are on one side of the cube.

In the described and illustrated embodiments, each cross-point has two conductors. It will be understood, however, that the cross-points may include more than two conductors, in which case the ball trains in the z-bars will consist of one single ball and have a correspondingly smaller recess in the bar. Similarly, cross-points may include more than two conductors, in which case the ball trains and the recesses in the z-bars will be correspondingly larger. It will also be understood that the configuration and positioning of the contact conductors and the links may also be modified so as to function in the intended manner.

The invention is, of course, not restricted to the aforedescribed and illustrated embodiments, since these embodiments can be modified within the scope of the following claims.

I claim:

1. A galvanic switch for electrically making or breaking one cross-point among a plurality of cross-points in a three-dimensional coupling matrix, wherein each of said cross-points may consist of one or more conductors, including electrical contact lines which extend in a first direction, first links which extend perpendicularly to said contact lines, second links which extend perpendicularly to both the contact lines and the first links, wherein each contact line, first link and second link, is comprised of a corresponding number of conductors, electrical contact elements at each cross-point for making or breaking electrical contact between the conductors of the contact lines and the conductors of the first or the second links respectively, and maneuvering elements for maneuvering the contact elements at said cross-point, including first maneuvering elements which are parallel with the contact lines and can be moved parallel thereto, second maneuvering elements which are parallel with the first links and can be moved parallel thereto, and third maneuvering elements which are parallel to the second links and can be moved parallel thereto, wherein the contact elements are comprised of spherical coupling elements arranged in and adjacent to each cross-point; in that the first maneuvering elements are disposed in first planes parallel with the contact conductors and the first links in order to move all coupling elements simultaneously adjacent respective cross-points in a selected cross-point plane; in that the second maneuvering elements are disposed in second planes parallel with the first links and the second links in order to move simultaneously all of the coupling elements moved by the first maneuvering elements in the intersection between the first selected plane and the selected second cross-point plane; and in that the third maneuvering elements are disposed in third planes parallel with the contact conductors and the second links in order to move the coupling elements moved by the first maneuvering elements and the second maneuvering elements in the intersection between the second selected plane and the third selected plane, said coupling elements, upon mechanical activation of respective maneuvering elements, being moved so as to establish contact with the contact conductors and the first links or the second links in order to make or break the cross-point electrically, depending on whether the coupling element is electrically conductive or electrically non-conductive, and in that maneuvering of the third maneuvering elements is used as a coupling function for brining into the cross-point a coupling element of a kind which is opposite to the kind of element that is already located in the cross-point.

2. A galvanic switch according to claim 1, wherein the maneuvering elements comprise recessed bars provided with recesses for accommodating the coupling elements.

3. A galvanic switch according to claim 1, wherein the coupling elements are comprised of a ball train located in the cross-points and alternating with electrically conductive and electrically non-conductive balls.

4. A galvanic switch according to claim 1, wherein the first and second links include contact tongues; and the coupling elements are disposed between the contact conductors and the contact tongues of said links.

5. A galvanic switch according to claim 4, wherein the contact tongues are embossed or roughened in some other way for holding the coupling elements in position.

6. A galvanic switch according to claim 1, wherein the maneuvering elements are activated in one direction by electromagnets and in the other direction by return springs.

* * * * *